United States Patent [19]

DuFresne

[11] Patent Number: 4,824,426

[45] Date of Patent: Apr. 25, 1989

[54] METHOD AND APPARATUS FOR INTERFOLDING WEBS

[75] Inventor: Allen J. DuFresne, Green Bay, Wis.

[73] Assignee: Paper Converting Machine Company, Green Bay, Wis.

[21] Appl. No.: 48,266

[22] Filed: May 11, 1987

[51] Int. Cl.[4] ..... B05B 1/14; B31F 1/00

[52] U.S. Cl. ..... 493/346; 270/39; 493/418; 493/433; 493/435

[58] Field of Search ..... 493/425, 432, 433, 434, 493/435, 418, 410, 346; 270/39, 40

[56] References Cited

U.S. PATENT DOCUMENTS

| | | | |
|---|---|---|---|
| 1,219,239 | 3/1917 | Brown et al. | 270/39 |
| 1,886,312 | 11/1932 | Stanton | 270/39 |
| 2,420,525 | 5/1947 | Deloye | 270/39 |
| 2,478,240 | 8/1949 | Christman . | |
| 2,870,840 | 1/1959 | Kwitek . | |
| 3,207,361 | 9/1965 | Marcalus | 270/39 |
| 4,279,411 | 7/1981 | Nystrand . | |
| 4,494,741 | 1/1985 | Fischer . | |
| 4,521,209 | 6/1985 | DuFresne . | |
| 4,691,908 | 9/1987 | Bradley | 270/21.1 |
| 4,721,295 | 1/1988 | Hathaway | 270/39 |

*Primary Examiner*—Frederick R. Schmidt
*Assistant Examiner*—Robert Showalter
*Attorney, Agent, or Firm*—Tilton, Fallon, Lungmus & Chestnut

[57] ABSTRACT

A method of zig-zag folding a pair of continuous webs or web segments (sheets) to provide stacks each having a specified number of segments wherein the segments are offset one-half segment length in one web from the other, the invention including reversely folding the leading edge portion of each web to provide a spacing for the insertion of stack separator means.

9 Claims, 1 Drawing Sheet

FIG. 1
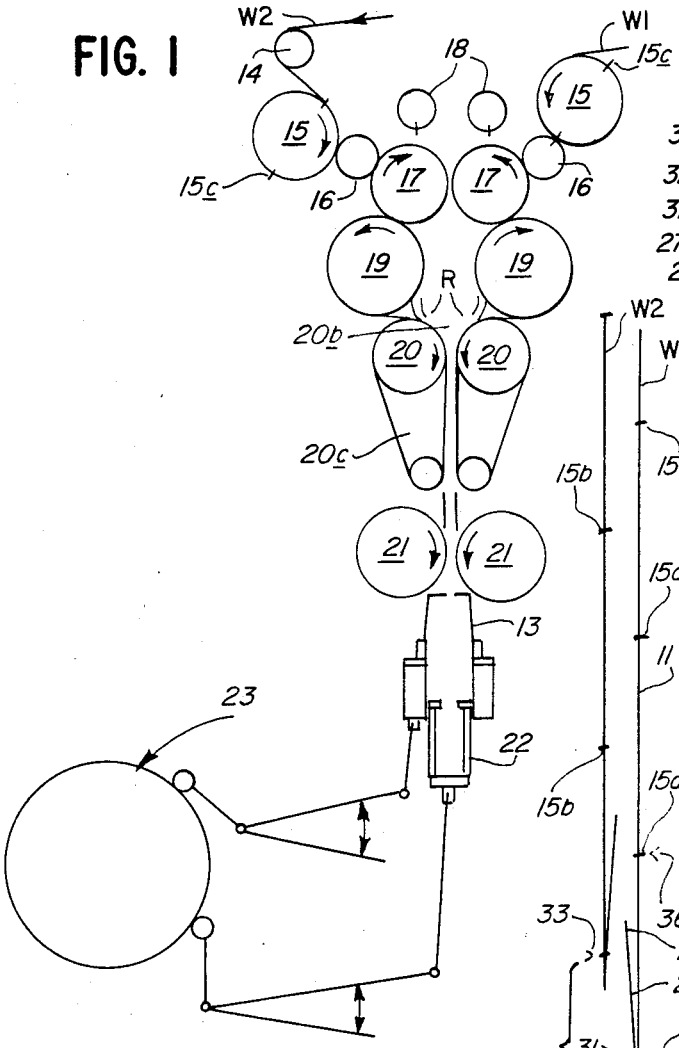
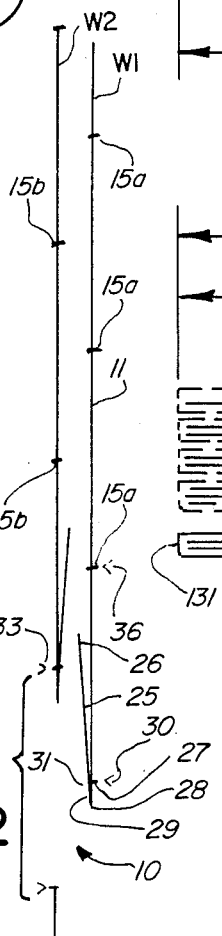
FIG. 2
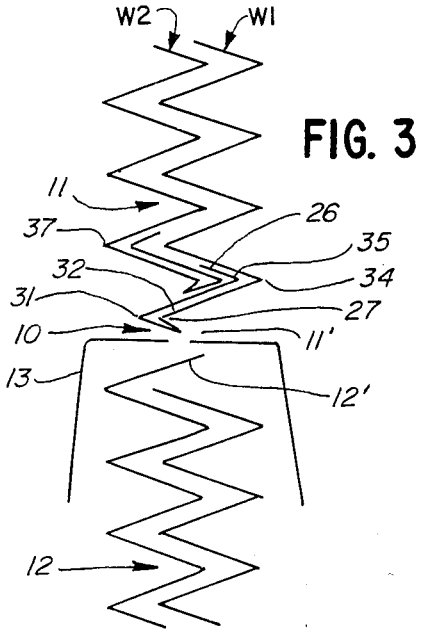
FIG. 3
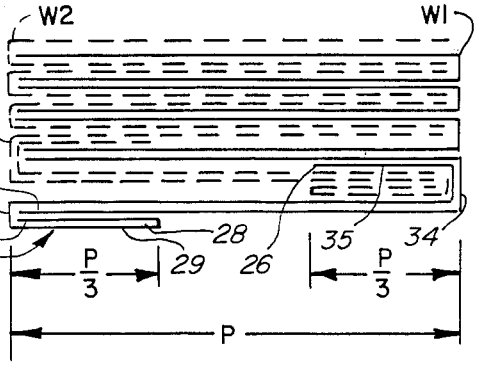
FIG. 4
FIG. 5
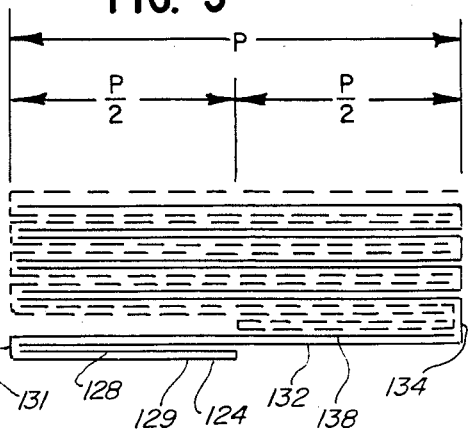
FIG. 6
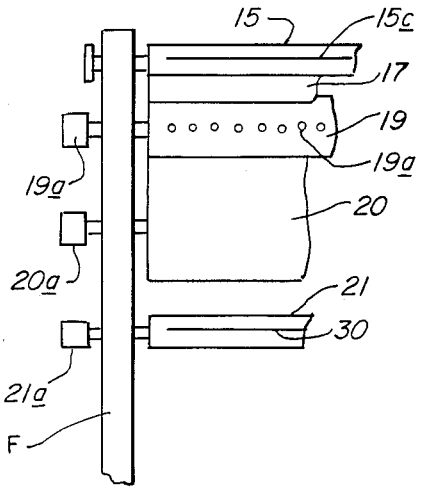

METHOD AND APPARATUS FOR INTERFOLDING WEBS

BACKGROUND OF INVENTION

This invention relates to a method and apparatus for interfolding webs and more particularly for providing discrete stacks each having the same number of web segments—each segment being "V" folded to provide a pair of panels, the segments being offset one panel length.

Interfolding has been practiced for a long time—whereby the removal of one web segment automatically places the succeeding web segment in a position for manual grasping. As such, it has been widely used for both paper towels and facial tissue. Interfolded tissues, for example, have been made in two ways. One way was to fold longitudinally 200 webs, then severing the stack. This had the drawback of dispensing the tissues in the weaker cross machine direction. The other way was to transversely interfold (normally by tuckers and grippers) two webs so that the dispensing was in the stronger machine direction. It is to the latter way that the instant invention is directed.

In transverse zig-zag folding, there has been a problem of separating one stack from another. This is true irrespective of whether the webs are transversely perforated—as in tissues or whether the webs are transversely severed—as in towels.

In the case of the tissues, the perforations result in small bonds connecting contiguous segments. Therefore, such webs are essentially continuous. When a predetermined "count" was reached, some means had to be provided for isolating the already achieved count from the web material continuing to issue from the interfolder. This normally was done manually—with markers of some type being inserted to indicate the place of separation. This was both back-breaking and costly. Further, the breaking of the bonds could disarrange the bottom segment.

In the case of towels, separator plates were inserted from opposite sides of the stack to flank the ending and beginning panels of succeeding stacks. When these plates were separated as by lowering the lower plate faster than the upper plate, the sheets became de-lapped. But, in doing this there was also the possibility of disarrangement because the segments were not under full control.

According to the instant invention, the stack separation is achieved by developing a spacing in the two continuous streams of contiguous web segments prior to the zig-zag folding. This spacing is achieved by reverse folding once each count the leading free edge of the leading segment of each stream.

Separation of segments or sheets prior to zig-zag folding has been performed previously, but not for use with a single folder. In both U.S. Pat. No. 4,494,741 and co-pending, co-owned application Ser. No. 816,441 filed Jan. 6, 1986, the separation was achieved for directing the web streams alternately to a pair of folders. More importantly, there was no suggestion of achieving the spacing by reverse folding.

The invention brings about additional advantages. Not only is the spacing between stacks achieved but further the reversely folded portion of the protruding web provides a starter tab for manual grasping to remove the web segments from a container and further, the reverse folding also provides a multiple thickness, longitudinally extending web portion to facilitate the zig-zag folding of the initial panel of a stack.

The invention is further explained in conjunction with an illustrative embodiment in the accompanying drawing, in which:

FIG. 1 is a side elevational view, essentially schematic, of apparatus illustrating the practice of the invention;

FIG. 2 is a side elevational view of the webs being processed—after reverse folding, but before zig-zag folding;

FIG. 3 is another side elevational view, again generally schematic, showing the webs after zig-zag folding and at the time of stack separation;

FIG. 4 is a side elevational view of a portion of a stack developed according to the preferred practice of the invention and where the reverse fold is ⅓ the length of a pane (a web segment or sheet consisting of two panels in length);

FIG. 5 is a view similar to FIG. 4 but wherein the reverse fold is ½ the panel length; and FIG. 6 is a fragmentary end elevational view of the apparatus of FIG. 1.

DETAILED DESCRIPTION

Referring to the drawing and particularly FIG. 2, the numeral 10 designates a spacing between the beginning of one stack 11 and the ending of the previous stack 12.

Now referring to FIG. 3, the stacks are seen to have been zig-zag folded and the beginning of the stack 11 is designated 11' while the ending of the stack 12 is designated 12'. From FIG. 3 it will be seen that stack separator means 13 are interposed in the spacing 10.

As indicated previously, the spacing 10 is achieved through reverse folding the leading edges of the webs intended for zig-zag folding. Apparatus for achieving this is now described with reference to FIG. 1.

Apparatus

At the top of FIG. 1 a pair of webs derived from parent rolls (not shown) are designated $W_1$ and $W_2$. Because the parent rolls are usually located side-by-side, a guide roll 14 is provided in the path of travel of web $W_2$ from its parent roll to its perforator roll 15. The web $W_1$ is shown to be entering in contact with its perforator roll 15 without the interposition of a guide-roll.

It will be appreciated, however, that, in accordance with conventional practice, a frame consisting of two side frames (one such being designated F in FIG. 6) is provided in which bearings are mounted for supporting the various rolls in rotatable fashion. The major portion of the frame normally will also include tensioning rolls or other means to insure that the webs coming from the parent rolls are properly tensioned. The frame and these various entering components have been omitted from the drawing for clarity of presentation and ease of understanding. However, they are provided as seen in the previously mentioned application and for details of the frame and other elements, express reference is made thereto.

The perforator rolls 15 transversely perforate the two webs $W_1$, $W_2$ along equally longitudinally spaced transverse lines. The perforations are designated schematically in FIG. 2 by the numeral **15*a* relative to the web $W_1$ and by the numeral 15*b* relative to the web $W_2$. From FIG. 2 it will be seen that the lines of perforation in one web are offset longitudinally from the lines of perforation in the other web, i.e., the lines 15b lie halfway between the lines 15a. For this purpose, the perforator rolls are suitably coordinated in their perforating action—as by phasing the perforating blades 15c in one roll intermediate the perforator blades in the other roll (compare FIGS. 1 and 6**). A typical construction of perforator is shown in co-owned U.S. Pat. No. 2,870,840.

After being perforated, the webs $W_1$, $W_2$ encounter transfer rolls 16 which direct the webs to rolls 17 which are also transfer rolls and further can serve the purpose of perforation breaking or cutoff rolls. The rolls 17 are equipped with vacuum ports so as to maintain the severed webs in contact with the surface of each of these rolls. Each of the perforator breaker rolls 18 has a blade protruding from its surface. When the roll is periodically (once each stack length) lowered toward its associated roll 17, the blade enters (co-acts with) a slot in the transfer roll 17 which action breaks or severs the bonds 15a or 15b.

When facial tissue is being interfolded, it is normally the practice not to rupture the bonds between adjacent sheets—except, in the practice of the invention to break the bonds at the beginning of the lead sheets or segments—so as to develop the spacing 10. On the other hand, with paper toweling, each segments is discrete and separate from the sheets in the web preceding and following the same. Therefore, where a machine is going to produce only interfolded toweling, the perforating function can be eliminated and a transverse severing function substituted—as seen in co-owned U.S. Pat. No. 2,478,240. Thus, the invention comprehends both types of transverse cutting: perforation and severance.

When leaving the transfer rolls 17, the webs (or contiguous segments) are transferred to vacuum transfer-folding rolls 19 which transfer the webs (or segments) to vacuum-belt rolls 20. Incident to this the reverse folds R are developed periodically—creating the space 10 at the start of each new stack of interfolded segments. Rolls 19 and 20 have dual vacuum systems which are controlled by solenoid valves 19a and 20a or other controller in the lines from the vacuum pump (not shown). Such intermittent application of vacuum to perform selective folding is well known. Illustrative of vacuum folding rolls is my earlier U.S. Pat. No. 4,521,209.

The webs now having their leading edges reversely folded are brought together in the nip 20b between rolls 20 and belts of transfer belt system 20c. Thereafter, the contacting webs are introduced between folding rolls 21 and the webs at this stage are in the configuration depicted in FIG. 2.

The folding rolls 21 are equipped with conventional tuckers and grippers (see co-owned U.S. Pat. No. 4,279,411). As seen in FIG. 6, the right hand folding roll has an intermittently activated vacuum system controlled by a solenoid valve 21a or other controller. This serves to carry the end 12' (see FIG. 3) of stack 12 to its proper position on top of stack 12 and assure that the end 12' is below stack separator means 13 as it enters the space 10.

Referring again to FIG. 1, the numeral 13 again designates the stack separator means which advantageously can be pivotally mounted fingers and below the fingers is provided an elevator 22. An elevator can be seen in co-owned, co-pending application Ser. No. 855,132 filed Apr. 22, 1986.

Thus, when the stack separator means 13 enter the spacing between stacks, the elevator 22 supports the now-completed stack and descends to carry it to a conveyor (not shown) which transports the finished stacks out of the machine to the next operation. The separator fingers 13 support the developing stack until the elevator has been returned to stack supporting position after which the stack separator fingers are retracted and elevated to a position for separating the next stacks. The numeral 23 designates generally cams and levers or equivalent operators which control the movement up-and-down, and in-and-out of the separator fingers 13 and the up-and-down movement of the elevator 22.

Starter Tab

To appreciate how the reverse folding develops a starter tab, reference is first made to FIG. 4 where the starter tab is designated 24. There the web $W_1$ is shown in solid line and the web $W_2$ in dashed line.

The starter tab 24 is developed in the web $W_1$ and provides a convenient finger graspable portion—as through a slot in the container (not shown)—for starting the extraction of tissues, towels, etc.

The leading segment in the web $W_1$ for a newly developing stack is designated by the numeral 25 in FIG. 2. This segment 25 extends from the former leading edge—now reversely folded and designated 26—through the next transverse line of perforation which is designated 27.

As indicated previously, a single segment includes two panels and this can be readily appreciated from a consideration of FIG. 4. In FIG. 4, the starter tab has two thicknesses each being one-third of a panel length. These two tab-forming portions are designated 28 and 29, and can also be seen in FIG. 2.

Also indicated in FIG. 2 is a tucker 30 of the right-hand folding roll 21. As the tucker 30 cooperates with its mating gripper (not shown) on the left hand folding roll, the web $W_1$ is folded—as seen in the central portion of FIG. 3—about the point 31, also so designated in FIG. 4.

This results in confining the leading portion of the next adjacent segment in the web $W_1$ as at 32 which also can be appreciated from a consideration of FIG. 3. The folding of the remainder of the leading segment in $W_1$ is achieved by the tucker 33 provided in the left hand folding roll 21—and with its cooperating gripper (not shown) in the right hand folding roll. This develops the fold designated 34 in FIGS. 3 and 4. More particularly, this develops the trailing portion 35 of the leading segment in web $W_1$ which lies between the fold line 34 and the end 26.

The next tucker 36 to operate against the combined webs generates the fold line 37. Tuckers 33 and 36 configure the leading segment of the web $W_2$ in a fashion identical (but mirror image) to that of the leading segment of the web $W_1$. As indicated previously, this is not needed for a starter tab but the web $W_2$ is transversely severed and reversely folded so as to provide the spacing 10.

Another advantage accrues through the practice of the invention and that resides in the fact that the reverse fold provides a multiple thickness of web material extending on both sides of the tucker 30 to facilitate tucking. It will be appreciated that tucking can be difficult if the tucker has only the leading edge to insert into the jaws of the gripper. This advantage also applies to zig-zag folders making use of other folding means such as vacuum rolls as contrasted to the tuckers shown.

Once the lead segment of the web $W_2$ has been transversely folded—as at 34—the remainder of the operation is conventional wherein alternate tuckers and grippers operate on each web successively to provide the usual configuration of interfolded webs.

In some instances it may be advantageous to provide a starter tab that projects further across the stack. Such a modification is seen in FIG. 5 where the starter tab is designated by the numeral 124. Here the starter tab is made up of two portions 128 and 129 each having a length of one-half panel, viz., one-quarter of the initial sheet length. The remainder, i.e., the full panel portion of the leading segment of web $W_1$ is designated 138 and extends between the fold lines 131 and 134. It has been found advantageous to provide a starter tab having a dimension across the stack of from about one-third to about one-half of the panel length. However, the starter tab may be less than one-third the panel length, but greater than zero length, viz., about 1/5 panel length and still be within the scope of this invention.

In the illustration given, it will be noted that the webs are reversely folded so that the lead portion confronts the other web, i.e., the reverse fold is sandwiched between the webs $W_1$ and $W_2$ proper. If the contrary were true of the lead sheet in web $W_1$, there is the possibility that grasping and pulling on the starter tab 24 might not cause the next sheet to become partially pulled out. As illustrated in FIG. 5, the portion 138 lies within the portion 132 and this facilitates the removal of the second sheet from the carton.

While in the foregoing specification a detailed description of the invention has been set down for the purpose of illustration, many variations in the details hereingiven may be made by those skilled in the art without departing from the spirit and scope of the invention.

I claim:

1. A method of interfolding webs to provide discrete stacks each having the same number of panels, comprising: advancing a pair of webs along first predetermined paths, each of said webs having equally longitudinally spaced lines of potential folding with the lines in one web being offset one panel length from the lines in the other whereby said webs provide adjacent lines when disposed side-by-side in a second path, severing said webs along a pair of adjacent lines to provide a leading edge in each web, reversely folding only once per stack each web a spaced distance from its leading edge to provide a spacing from the trailing edge of the preceding panel of the same web, zig-zag folding said webs together along said fold lines whereby said spacing provides entry areas for stack separator means to develop said discrete stacks and the reverse folding provides a starter tab for manual grasping to remove panels from a dispenser, said reverse folding also providing multiple thickness, longitudinally extending web portions to facilitate said zig-zag folding of the initial panel of a stack.

2. The method of claim 1 in which said webs are perforated along said lines before said severing.

3. The method of claim 1 in which said webs are severed along all of said lines prior to zig-zag folding.

4. The method of claim 1 in which said reverse folding provides a flap positioned between its associated web and the other of said webs.

5. The method of claim 1 in which said reverse folding provides a tab having a dimension in the direction of web movement up to about ½ the length of a panel.

6. In a method of zig-zag folding a pair of continuous webs to provide stacks each having a specified number of segments wherein the segments are offset one-half segment length in one web from the other, the steps of severing said webs between stacks and reversely folding on itself a portion only of the leading stack segment of each web to provide a spacing from the trailing segments of the stack preceding, and zig-zag folding said webs together along equally spaced transverse lines.

7. The method of claim 6 in which each web is transversely cut between each segment.

8. The method of claim 6 in which stack separator means are interposed in said spacing following zig-zag folding.

9. The method of claim 6 in which the folding is achieved by tuckers and grippers, a first set of said tuckers and grippers operating against multiple web thickness spaced rearward of the reverse fold line in the forwardly projecting web to provide a starter tab for each stack.

* * * * *